US009574540B2

(12) United States Patent
Stifel

(10) Patent No.: US 9,574,540 B2
(45) Date of Patent: Feb. 21, 2017

(54) CORONA IGNITION DEVICE

(71) Applicant: BorgWarner BERU Systems GmbH, Ludwigsburg (DE)

(72) Inventor: Timo Stifel, Korntal-Münchingen (DE)

(73) Assignee: BORGWARNER BERU SYSTEMS GMBH (DE)

( * ) Notice: Subject to any disclaimer, the term of this patent is extended or adjusted under 35 U.S.C. 154(b) by 643 days.

(21) Appl. No.: 14/068,838

(22) Filed: Oct. 31, 2013

(65) Prior Publication Data

US 2014/0123925 A1 May 8, 2014

(30) Foreign Application Priority Data

Nov. 7, 2012 (DE) ..... 10 2012 110 657

(51) Int. Cl.
*F02P 23/04* (2006.01)
*F02P 11/00* (2006.01)

(52) U.S. Cl.
CPC ..... *F02P 23/04* (2013.01); *F02P 11/00* (2013.01); *F02P 23/045* (2013.01)

(58) Field of Classification Search
CPC F02P 23/04; F02P 11/00; F02P 23/045; F02P 9/00; F02P 9/007; H01T 21/02; H01T 19/00; H01T 19/04
USPC ..... 123/143 R, 143 A, 143 B; 313/141
See application file for complete search history.

(56) References Cited

U.S. PATENT DOCUMENTS 4,124,003 A * 11/1978 Abe ..... F02B 17/00 123/169 EL
5,704,321 A * 1/1998 Suckewer ..... H01T 13/50 123/143 B
6,191,525 B1 2/2001 Tanaka et al.
6,225,752 B1 5/2001 Matsubara et al.
7,408,562 B2 * 8/2008 Kotsuji ..... H01T 23/00 347/123
7,652,414 B2 1/2010 Jaffrezic et al.
8,729,782 B2 * 5/2014 Lykowski ..... F02P 23/04 313/141
8,839,752 B2 * 9/2014 Burrows ..... H01T 13/50 123/143 B (Continued)

FOREIGN PATENT DOCUMENTS

CN 2071395 U 2/1991
DE 10 2012 108 251 A1 4/2013

(Continued)

*Primary Examiner* — Hung Q Nguyen
*Assistant Examiner* — John Bailey
(74) *Attorney, Agent, or Firm* — Bose McKinney & Evans LLP

(57) ABSTRACT

The invention relates to a corona ignition device for igniting fuel in a combustion chamber of an engine by means of a corona discharge, comprising an insulator, which has a continuous channel, a central electrode, which plugs into the channel of the insulator and leads to at least one ignition tip, a glass seal, which seals in the channel a gap between the central electrode and the insulator, and a housing, into which the insulator plugs. In accordance with the invention, the central electrode has a sealing face, which, together with a sealing face of the insulator, forms a seat, and an annular air gap that is open towards the ignition tip is provided in an end portion of the channel, facing the ignition tip, between the central electrode and the insulator.

9 Claims, 2 Drawing Sheets

(56) References Cited

U.S. PATENT DOCUMENTS

2007/0221156 A1* 9/2007 Hagiwara ..... F02P 9/007 123/143 B
2007/0221157 A1* 9/2007 Hagiwara ..... F02P 9/007 123/143 B
2008/0238283 A1* 10/2008 Nakamura ..... H01T 13/50 313/143
2009/0194053 A1* 8/2009 Nakamura ..... H01T 13/50 123/143 B
2009/0227169 A1* 9/2009 Nakamura ..... H01T 13/50 445/7
2010/0132666 A1* 6/2010 Sato ..... H01T 13/50 123/406.19
2010/0282197 A1* 11/2010 Permuy ..... H01T 19/04 123/143 B
2011/0146640 A1* 6/2011 Achstaetter ..... H01T 13/36 123/608
2012/0080995 A1* 4/2012 Yamamura ..... H01T 13/32 313/141
2012/0112620 A1* 5/2012 Lykowski ..... F02P 23/04 313/141
2012/0180743 A1* 7/2012 Burrows ..... H01T 13/50 123/169 R
2012/0210968 A1* 8/2012 Burrows ..... H01T 13/50 123/143 B
2012/0279468 A1* 11/2012 Burrows ..... H01T 13/50 123/143 B
2013/0003251 A1* 1/2013 Durham ..... H01T 13/50 361/253
2013/0199484 A1* 8/2013 Stifel ..... H01T 13/467 123/143 B

FOREIGN PATENT DOCUMENTS

EP 1 039 602 A1 9/2000
EP 1 515 594 A2 3/2005
EP 1 897 193 B1 5/2010
WO WO 2008/154115 A2 12/2008
WO WO 2012/082868 A1 6/2012
WO WO 2012/097290 A1 7/2012

* cited by examiner

CORONA IGNITION DEVICE

RELATED APPLICATIONS

This Application claims priority to DE 10 2012 110 657.6, filed Nov. 7, 2012, which is incorporated herein by reference in its entirety.

BACKGROUND

The invention relates to a corona ignition device for igniting fuel in a combustion chamber of an engine by means of a corona discharge.

Corona ignition devices are an alternative to spark plugs, which ignite fuel as a result of an arc discharge. Corona ignition devices by contrast cause an ignition by means of a corona discharge and therefore have the potential of a much longer service life. Corona discharges specifically cause much less burn-up at an ignition tip compared to arc discharges.

Corona discharges at an ignition tip are generated by high-frequency excitation of an electric resonating circuit. The capacitor of this resonating circuit is formed by the housing of the corona ignition device and a central electrode, which leads to the ignition tip. The central electrode sits in a channel of an insulator, which closes the combustion-chamber-side end of the housing in a gas-tight manner. A glass seal is located in the channel of the insulator in order to prevent leaking of combustion chamber gases.

A frequent cause of premature failure of corona ignition devices is a dielectric breakdown inside the corona ignition device.

SUMMARY

The present invention provides a way in which the service life of corona ignition devices can be increased.

With a corona ignition device according to this disclosure, the central electrode has a sealing face, which, together with a sealing face of the insulator, forms a sealing seat. Surprisingly, the risk of a premature failure of the corona ignition device can thus be reduced considerably.

The glass seal of a corona ignition device is subjected to a significant temperature load, which may cause the glass seal to become soft during operation and may allow contaminations to infiltrate the channel. The risk of breakdown and partial discharges, which may lead to a premature failure of the corona ignition device, is thus increased. Deposits of fuel residues in a portion of the channel filled with glass accumulate over time and increasingly reduce the dielectric strength until this ultimately results in dielectric breakdown. Due to the seat, in particular due to a conical seat, an outstanding seal is ensured, even if the glass seal becomes soft.

The sealing face of the central electrode is preferably pressed with a bias against the sealing face of the insulator. The seal can thus be improved yet further, in particular even if the glass seal becomes soft.

An annular air gap that is open towards the ignition tip may be provided in an end portion of the channel, facing the ignition tip, between the central electrode and the insulator. The glass seal is thus arranged at a distance from the combustion-chamber-side end of the insulator body and is therefore exposed only to a reduced thermal load. The improved seal hinders infiltration of combustion chamber gases and contaminants into the glass seal and into a channel portion arranged behind the seat. The risk of breakdown and partial discharges is thereby advantageously reduced. Deposits of fuel residues in the air gap can be burned by corona discharges, such that breakdown and partial discharges can be avoided at this point too.

In order to facilitate the formation of a corona discharge in the air gap and to thereby prevent the collection of fuel residues, a portion of the central electrode and/or the surface of the insulator may cause in the air gap a field peak for generation of a corona discharge in the air gap. For example, the central electrode and/or the inner face of the insulator may have an increased roughness in the end portion of the channel, that is to say a greater roughness compared to the main portion of the channel containing the glass seal. Alternatively or additionally, a portion of the central electrode between the ignition tip and the sealing face of the central electrode may have a peripheral edge. An edge causes a local increase of the electric field, that is to say a field peak, and therefore leads to a corona discharge.

A sealing seat may lead to local increases of the electric field and may therefore be accompanied by the risk of dielectric breakdown between the central electrode and housing. In accordance with an advantageous refinement of this disclosure, the combustion-chamber-side end of the insulator protrudes from the housing, for example by a length B, and the seal is arranged in this end portion of the insulator, for example at a distance A from the combustion-chamber-side end of the insulator. The sealing face of the central electrode is thus arranged fully outside the housing. Due to sufficient distancing of the sealing faces from the housing, dielectric breakdown can be avoided, even if edges of the sealing faces cause local field superelevations or field peaks. The ratio of A to B may be 0.3 to 0.7; for example A/B may be in the range of 0.4 to 0.6.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
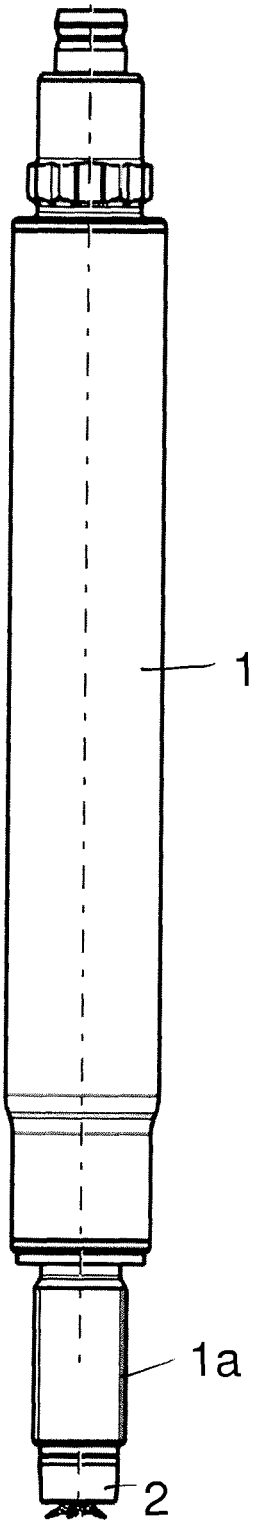
FIG. 1 shows an illustrative embodiment of a corona ignition device according to the invention.
Figure 2:
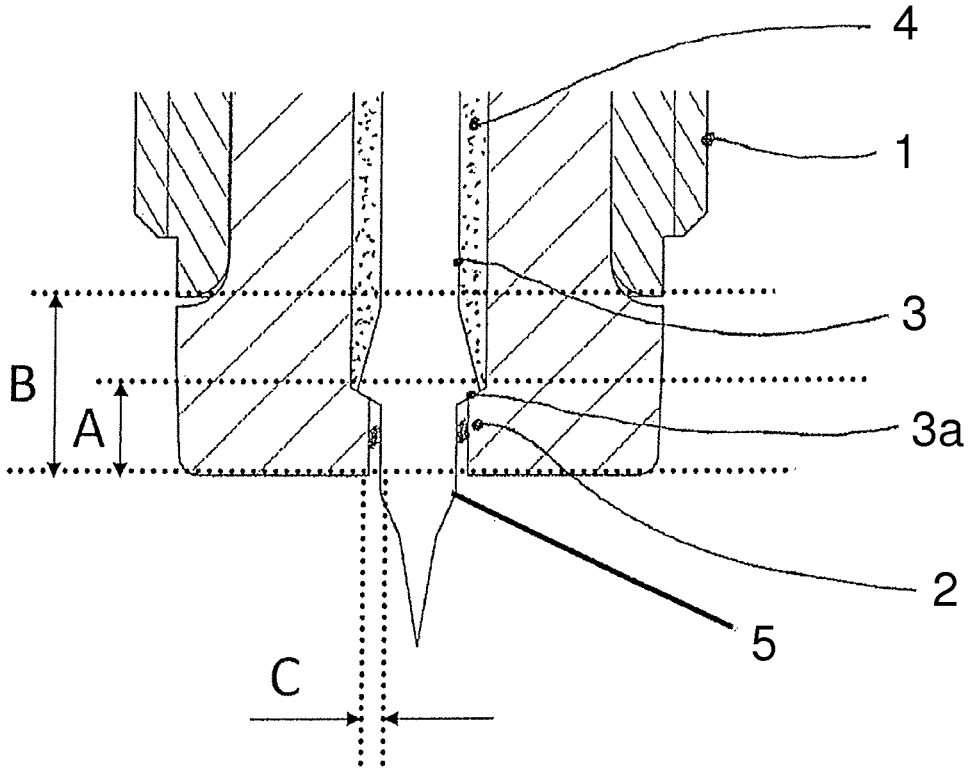
FIG. 2 shows a schematic side view of the combustion-chamber-side end of a corona ignition device.

The corona ignition device illustrated in FIG. 1 has a housing 1, which is closed at one end by an insulator 2. As is shown in particular in FIG. 2, a central electrode 3 is stuck or fixed in the insulator 2 and leads to at least one ignition tip. A plurality of ignition tips is illustrated in FIG. 1, whereas only a single ignition tip is illustrated in FIG. 2 for the sake of simplicity. If an ignition head having a plurality of ignition tips is secured to the central electrode, a corona discharge can be generated in a larger volume.

The central electrode 3, together with the insulator 2 and the housing 1, forms a capacitor which is connected in series to a coil attached to the central electrode 3. This capacitor and the coil arranged in the housing form an electric resonating circuit, the excitation of which can lead to generation of corona discharges at the ignition tip or the ignition tips.

An end portion 1*a* (FIG. 1) of the housing 1 surrounding the insulator 2 may have an outer thread 1*b* for screwing into an engine block. Instead of an outer thread, the corona ignition device may also be secured by other means to an engine block.

As is shown in FIG. 2, the central electrode 3 is arranged in a continuous channel of the insulator 2, where it is surrounded by a glass seal 4. The continuous channel is a through hole. The glass seal 4 is preferably made of conductive glass, for example of glass that has been made electrically conductive by conductive additives, such as graphite particles or metal particles.

In the channel, the glass seal 4 seals an annular gap between the central electrode 3 and the insulator 2. To improve the seal, the central electrode 3 has a conical sealing face 3*a*, which, together with a conical sealing face of the insulator 2, forms a seat. The sealing face 3*a* of the central electrode 3 can be pressed with a bias against the conical sealing face of the insulator 2 so as to ensure a reliable seal with respect to combustion chamber gases, even if the glass seal 4 becomes soft.

In the illustrative embodiment, the sealing face of the insulator 2 is formed in that the channel has a conically tapering portion which borders a main portion containing the glass seal. An end portion, which can be shaped cylindrically similarly to the main portion, but is narrower than the main portion, adjoins the conically tapering portion 2. The end portion of the channel may also widen, for example conically, towards its end facing away from the seat. An advantageous migration of corona discharges in the air gap can thus be achieved.

Between the seat and the end of the insulator 2 facing the ignition tip, the central electrode 3 is surrounded by an air gap that is open towards the ignition tip and therefore towards the combustion chamber. The combustion-chamber-side end portion of the channel specifically has a larger diameter than the portion of the central electrode 3 arranged therein.

The central electrode 3 widens at its sealing face. An end portion of the insulator 2 facing the ignition tip protrudes from the housing 1. This lowers the risk of dielectric breakdown. The seat is located in this end portion of the insulator 2. On the one hand, the sealing face of the central electrode 3 should not lead to dielectric breakdown relative to the housing 1. For this purpose, a maximum distance to the end of the housing 1 is advantageous. On the other hand, the seat should be thermally loaded to a minimal extent. For this purpose, a maximum distance from the ignition tip is advantageous.

In the illustrative embodiment shown, the insulator 2 protrudes with an end portion of length B from the housing 1. This length B is greater than the length A of the annular air gap in the channel of the insulator 2. A length ratio A/B in the range from 0.3 to 0.7 is advantageous. It is particularly advantageous of the length A is between four and six tenths of the length B.

It is also possible to arrange the seat in the housing 1. Then, the distance A of the seat from the combustion-chamber-side end of the insulator 2 should be at least 1.3 times the length B, for example it is advantageous if the ratio A/B is in the range from 1.5 to 2.0.

A high field strength, which promotes the creation of corona discharges, is produced in the air gap, which preferably has a width C from 0.05 mm to 0.5 mm Corona discharges in the air gap burn any combustion residues present and thus prevent a coking of the air gap.

To assist the formation of a corona discharge in the air gap, field peaks can be generated selectively, for example in that an end portion of the central electrode 3 and/or the surface of the insulator 2 in the end portion of the channel are roughened. Edges on the central electrode 3 are particularly effective. For example, a peripheral edge 5 can be formed by a diameter change at an end portion of the central electrode 3. Such an edge 5 can be arranged in the insulator 2 outside the insulator 2. If it is arranged outside, it is preferable for the central electrode to taper less severely in a region bordering the edge 5 than in an adjoining region. It is also possible, in an end portion of the channel, to provide an edge in order to facilitate the formation of a corona discharge in the air gap.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A corona ignition device for igniting fuel in a combustion chamber of an engine by means of a corona discharge, comprising:

an insulator, which has a continuous channel;

a central electrode, which is disposed in the continuous channel of the insulator and leads to at least one ignition tip;

a glass seal, which seals the continuous channel; and a housing in which the insulator is disposed, wherein the central electrode has a sealing face, which, together with a sealing face of the insulator, forms a seat;

an annular air gap between the central electrode and the insulator, said annular air gap being open towards the ignition tip in an end portion of the continuous channel, said end portion facing the ignition tip; and wherein an end portion of the insulator facing the ignition tip protrudes from the housing and the sealing face of the insulator is disposed on the end portion of the insulator.

2. The corona ignition device according to claim 1, wherein the annular air gap is shorter than the end portion of the insulator.

3. The corona ignition device according to claim 2, wherein the ratio of the length of the annular air gap to the length of the end portion of the insulator is in the range from 0.3 to 0.7.

4. The corona ignition device according to claim 1, wherein the sealing face of the central electrode and the sealing face of the insulator are conical.

5. The corona ignition device according to claim 1, wherein the end portion of the continuous channel is narrower than a main portion of the continuous channel containing the glass seal.

6. The corona ignition device according to claim 1, wherein a portion of the central electrode and/or a surface of the insulator causes in the annular air gap a field peak for generation of a corona discharge in the annular air gap.

7. The corona ignition device according to claim 1, wherein a portion of the central electrode has a peripheral edge configured to facilitate formation of a corona discharge in the annular air gap.

8. The corona discharge device according to claim 1, wherein the sealing face of the central electrode is pressed with a bias against the sealing face of the insulator.

9. A corona ignition device for igniting fuel in a combustion chamber of an engine by means of a corona discharge, comprising:

an insulator, which has a continuous channel;

a central electrode inserted in the continuous channel of the insulator and protruding from a first end of the insulator;

a glass seal arranged in a section of the continuous channel and sealing the channel; and a housing having an opening in which the insulator is held;

wherein the central electrode has a conical sealing face engaging a matching conical sealing face of the insulator; and wherein a section of the central electrode is surrounded in the continuous channel of the insulator by an annular air gap, said annular air gap being open towards the first end of the insulator; and wherein the first end of the insulator protrudes from the housing and the conical sealing face of the insulator is disposed on a portion of the insulator protruding from the housing.

* * * * *